US006511291B2

(12) United States Patent
Koochingchai

(10) Patent No.: US 6,511,291 B2
(45) Date of Patent: Jan. 28, 2003

(54) BLOWER ASSEMBLY WITH MULTI SEGMENTED SUPPORT ARRANGEMENT FOR SPLIT AIR CONDITIONER

(76) Inventor: Pong Koochingchai, P.O. Box 487, Chang-Hua City 500 (TW)

( * ) Notice: Subject to any disclaimer, the term of this patent is extended or adjusted under 35 U.S.C. 154(b) by 41 days.

(21) Appl. No.: 09/755,151

(22) Filed: Jan. 8, 2001

(65) Prior Publication Data

US 2002/0067986 A1 Jun. 6, 2002

(30) Foreign Application Priority Data

Dec. 1, 2000 (TW) ..... 089220874

(51) Int. Cl.[7] ..... F04D 5/00

(52) U.S. Cl. ..... 415/229; 415/53.1; 415/60; 415/216.1; 62/262; 384/434

(58) Field of Search ..... 415/53.1, 53.2, 415/53.3, 170.1, 214.1, 216.1, 229, 60; 417/363, 423.5, 423.15, 423.12; 62/262; 384/434

(56) References Cited

U.S. PATENT DOCUMENTS 2,686,630 A * 8/1954 Burrowes ..... 417/363
2,872,253 A * 2/1959 Foote et al. ..... 384/434
3,223,313 A * 12/1965 Kinsworthy ..... 415/53.1
3,250,457 A * 5/1966 Walker ..... 415/53.1
3,936,100 A * 2/1976 Moores, Jr. et al. ..... 384/434
4,652,151 A * 3/1987 Siebert ..... 384/434
5,638,692 A * 6/1997 Aizawa et al. ..... 62/262
6,023,936 A * 2/2000 Choi ..... 62/285

FOREIGN PATENT DOCUMENTS

JP 62-251494 A * 11/1987 ..... 415/170.1
JP 1-98838 A * 4/1989 ..... 62/262

* cited by examiner

*Primary Examiner*—Christopher Verdier

(57) ABSTRACT

A blower assembly for a split air conditioner comprises a casing having a bearing trough in one end, a pair of rubber sleeve troughs in the other opposite end, a plurality of central hollow posts each having a threaded hole; and a blower having a plurality of blower units each having a shaft in one end and a hole in the other opposite end, at least one bearing seat, a plurality of bearings, at least one motor, a plurality of rubber sleeves mounted on the motor and together rested on the rubber sleeve troughs, and a plurality of plates for threadedly securing the rubber sleeves. By utilizing these components, a variety of advantages are obtained such as an increase of draft, more stable operation, no abnormal expansion and contraction, and noise reduction.

2 Claims, 9 Drawing Sheets

BLOWER ASSEMBLY WITH MULTI SEGMENTED SUPPORT ARRANGEMENT FOR SPLIT AIR CONDITIONER

FIELD OF THE INVENTION

The present invention relates to air conditioners and more particularly to a blower with a multi segmented support arrangement for a split air conditioner.

BACKGROUND OF THE INVENTION

A conventional blower assembly A for a split air conditioner is shown in FIG. 9 wherein a blower B is rotatably mounted between a shaft C1 of a motor C and a bearing D. Both motor C and bearing D are threadedly secured to the casing of a blower assembly A. Further, the blower B consists of a plurality of integrally formed blower units. It is seen that blower B is supported by only shaft C1 and the bearing D. Hence, several disadvantages are found in the practical use. For example, the gravitational center of blower B may be lowered when blower B is prolonged for increasing draft length. This further increases vibration during the operation of the blower assembly A. Furthermore, the lifetimes of the bearing D and motor C are shortened. Moreover, abnormal expansion and contraction of the blower B occur. This may cause the blades of blower B to rotate eccentrically, resulting in the increment of noise. Thus there is an eager demand to improve the defect in the prior art.

SUMMARY OF THE INVENTION

It is therefore an object of the present invention to provide a blower assembly for a split air conditioner comprising a casing having a bearing trough in one end, a pair of rubber sleeve troughs in the other opposite end, a plurality of central hollow posts each having a threaded hole; and a blower having a plurality of blower units each having a shaft in one end and a hole in the other opposite end, at least one bearing seat, a plurality of bearings, at least one motor, and a plurality of rubber sleeves mounted on the motor and rested on the rubber sleeve troughs, and a plurality of plates for threadedly securing the rubber sleeves. By utilizing these components, a variety of advantages are obtained such as the increase of the length of the draft, a more stable operation, no abnormal expansion and contraction of the blower assembly, and noise reduction.

The above and other objects, features and advantages of the present invention will become apparent from the following detailed description taken with the accompanying drawings.

DETAILED DESCRIPTION OF THE PREFERRED EMBODIMENTS

Figure 1:
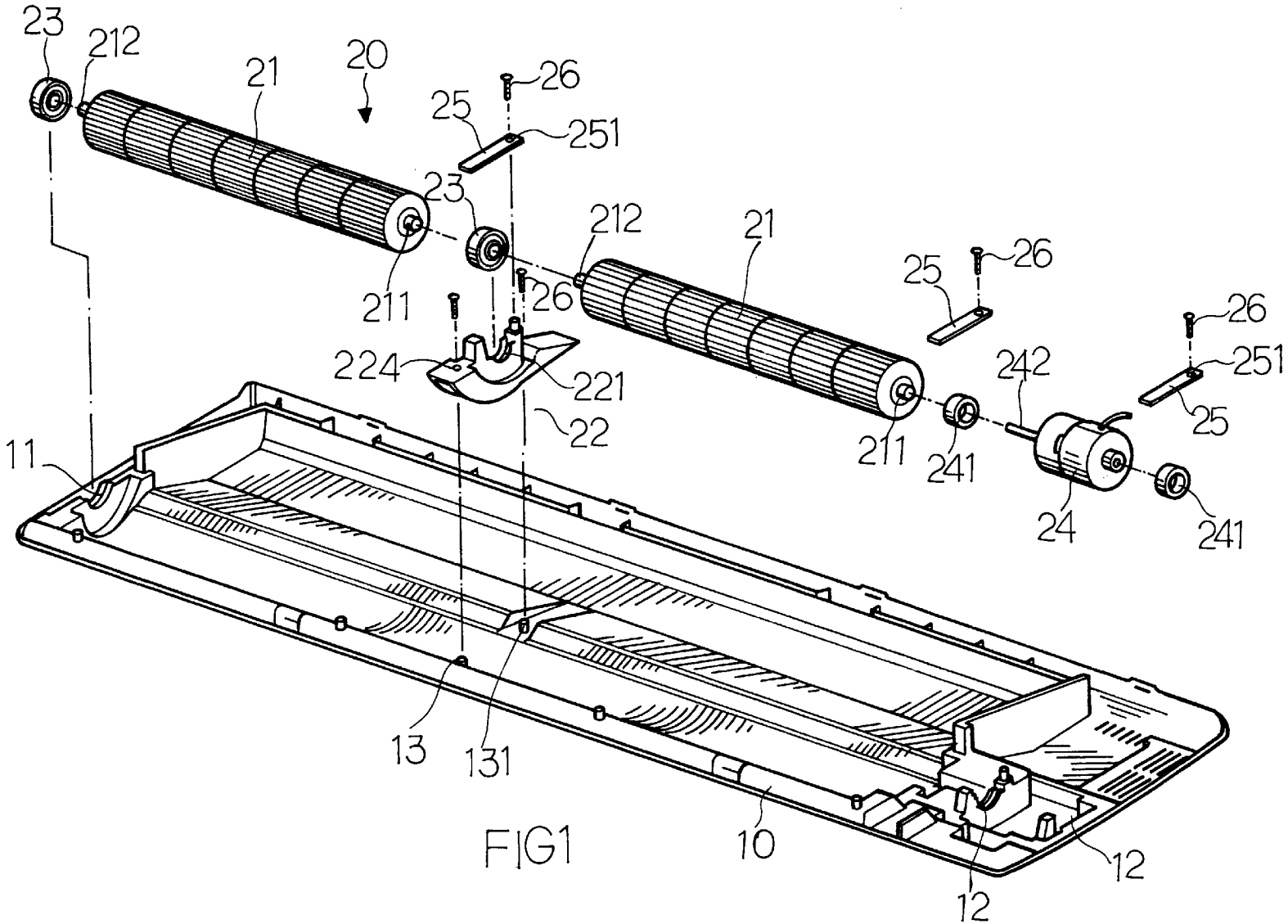
FIG. 1 is an exploded view of a first preferred embodiment of the blower assembly with two segments support and one motor arrangement for the split air conditioner according to the present invention.
Figure 2:
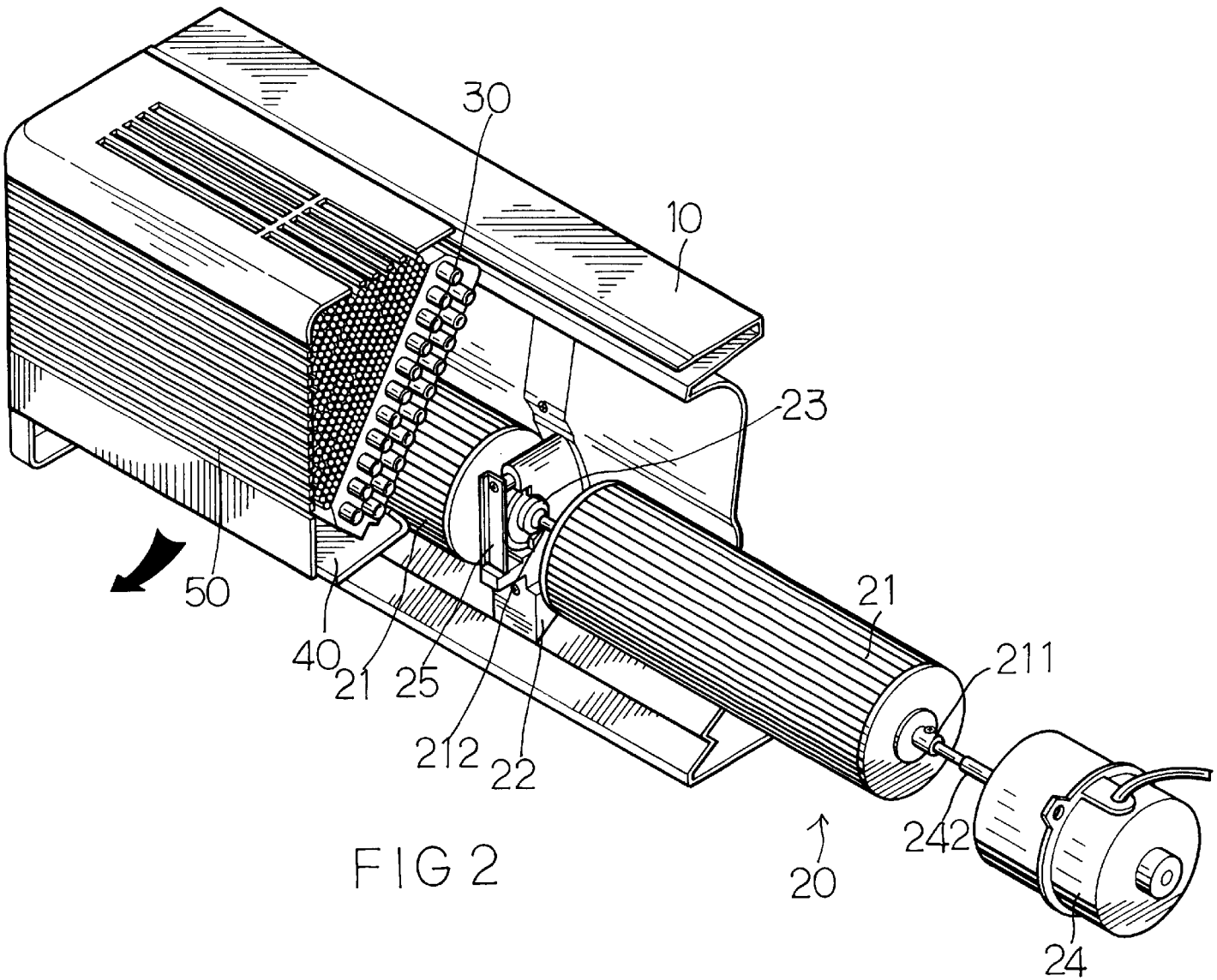
FIG. 2 is a perspective view of the embodiment of FIG. 1 with a portion broken away to reveal certain components of the blower assembly.
Figure 3:
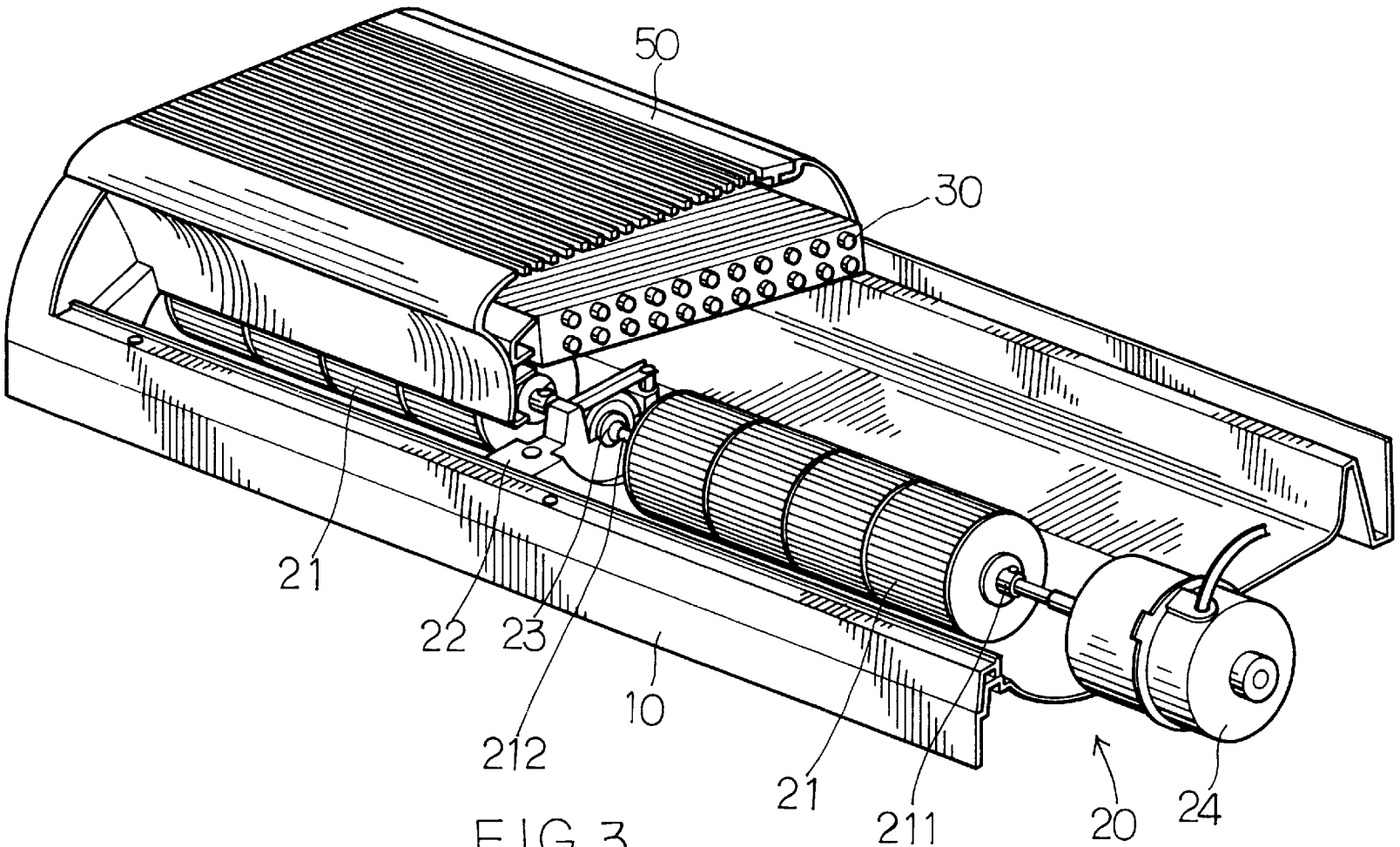
FIG. 3 is another perspective view of the embodiment of FIG. 1 with a portion broken away to reveal certain components of the blower assembly.

Referring to FIGS. 1 to 6, the blower assembly for the split air conditioner in accordance with the present invention is shown. The blower assembly is provided within a house, while the main body of the air conditioner is provided outside the house. Blower assembly comprises a casing 10, a blower 20, an evaporator 30, a pan 40, and a louver 50. The casing 10 is an elongate parallelepiped structure and comprises a bearing trough 11 in one end, and a pair of rubber sleeve troughs 12 in the other opposite end, and a plurality of central hollow posts 13 each having a threaded hole 131. In the embodiment of FIG. 1, blower 20 comprises two blower units 21, a bearing seat 22, two bearings 23, and a motor 24. A plurality of rubber sleeves 241 are put on two ends of motor 24 and are rested on rubber sleeve troughs 12. Then rubber sleeves 241 are pressed by plates 25 and then are threadedly secured together by the driving screws 26 through holes 251. Hence, the motor 24 may stably operate on casing 10. A bearing 23 in the central portion of the bottom of casing 10 is anchored on an arcuate trough 221 of the bearing seat 22. A slot 222 is provided on one upward section of trough 221 and a threaded hole 223 is provided on the other upward section of the trough 221. A threaded hole 224 is formed adjacent to the slot 222 on the bearing seat 22. As such, screw 26 may drive through threaded hole 224 to secure the bearing seat 22 to casing 10. The arcuate bearing seat 22 is shaped to conform to the bottom of the casing 10. A shaft 212 is provided on one end of the blower unit 21 is inserted into the bore of the bearing 23. A threaded hole 211 is provided on the other end of the blower unit 21 for receiving and corotating with the shaft 242 of the motor 24. In the two blower units 21 arrangement, the connection therebetween is that shaft 212 of the other blower unit 21 is inserted through a bearing 23 and into the threaded hole 211 of one blower unit 21 (see FIG. 1).

In assembly, the first drive screws 26 are passed through the holes 224 of the bearing seat 22 and the holes 131 of the posts 13 for securing bearing seat 22 to the casing 10. Then the hole 211 of the blower unit 21 is inserted around the shaft 242 of the motor 24. Next, the shaft 212 of the same blower unit 21 is inserted into the bearing 23 and the hole 211 of another blower unit 21. Then these components are threadedly secured together. A bearing 23 is put on the shaft 212 of another blower unit 212. Then the assembled blower 20 is placed on casing 10 wherein the bearing 23 between the two blower units 21 is rested on the trough 221 of the bearing seat 22. Then the bearing 23 is pressed by the plate 25 with one end of the plate 25 being inserted into the slot 222. Then the screw 26 is driven through the hole 251 and hole 223 to secure the bearing 23 to the bearing seat 22. The bearing 23 at one end of the assembled blower units 21 is rested on bearing trough 11, while the other end of the assembled blower units 21 is secured to the motor 24. The rubber sleeves 241 are rested on the rubber sleeve troughs 12. The bearing 23 and rubber sleeves 241 are pressed by the plate 25 and further threadedly secured to the casing 10. The two blower units 21 has a larger draft as compared to the single blower unit 21 when the motor 24 is activated. The invention further has the following advantages. For example, the gravitational center of the blower 20 is not lowered. This does not increase vibration during the normal operation of blower 20. Moreover, abnormal expansion and contraction of blower 20 are substantially eliminated. In addition, noise is reduced in operation.

Figure 4:
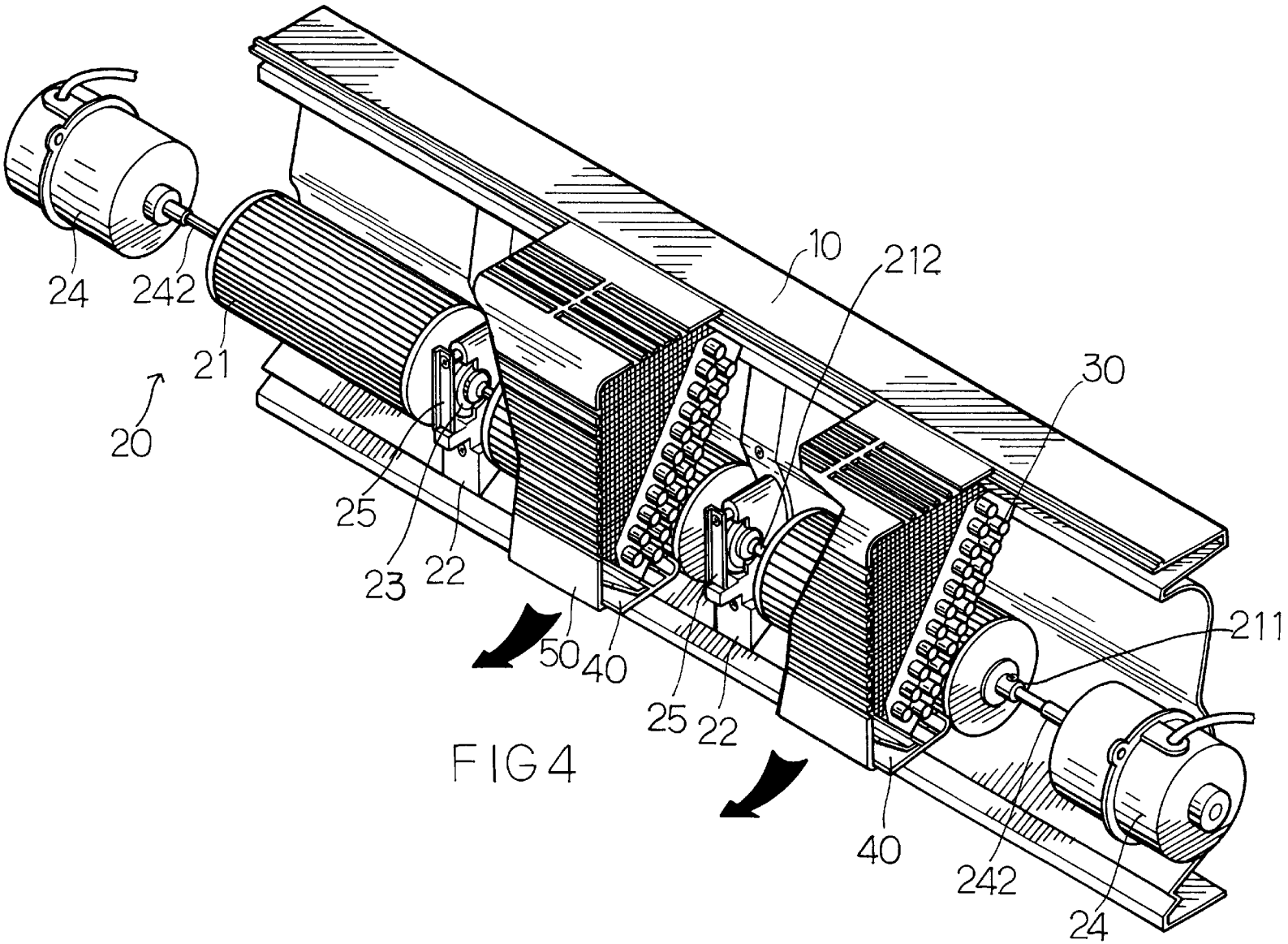
FIG. 4 is a perspective view of a second preferred embodiment of the blower assembly with three segments support and two motors arrangement for the split air conditioner according to the invention with a portion broken away to reveal certain components of the blower assembly.
Figure 5:
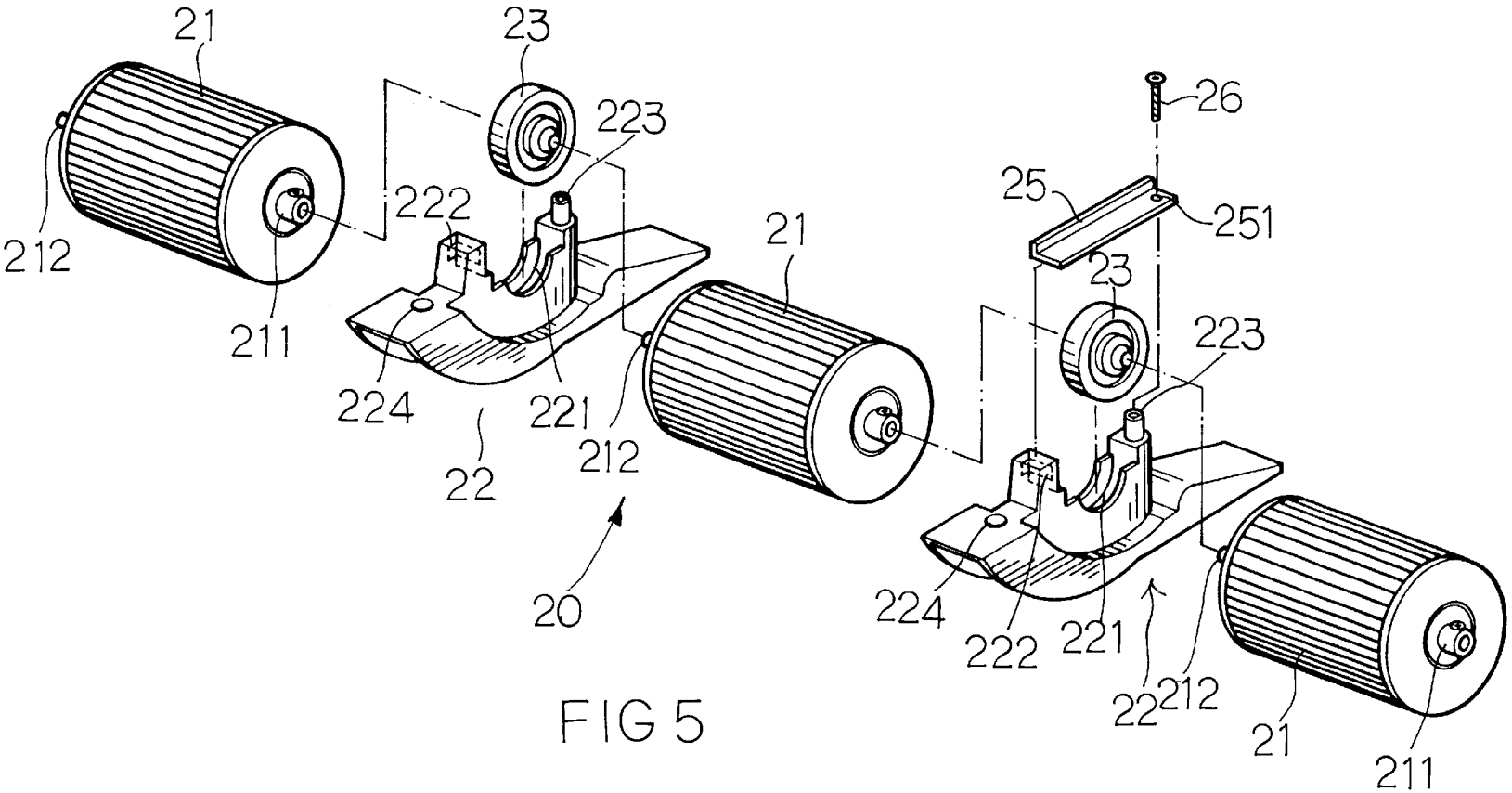
FIG. 5 is an exploded perspective view illustrating a double bearing seat arrangement of the blower assembly according to the invention.

Referring to FIGS. 4 and 5, there is shown a blower consisting of the three blower unit 21 for the split air conditioner according to the invention. The assembly procedure of the embodiment, is the same as that shown in FIGS. 1 to 3. Thus a detailed description thereof is eliminated for the sake of brevity. It is understood that, however, the blower assembly may consist of more than three blower units in other embodiments.

Figure 6:
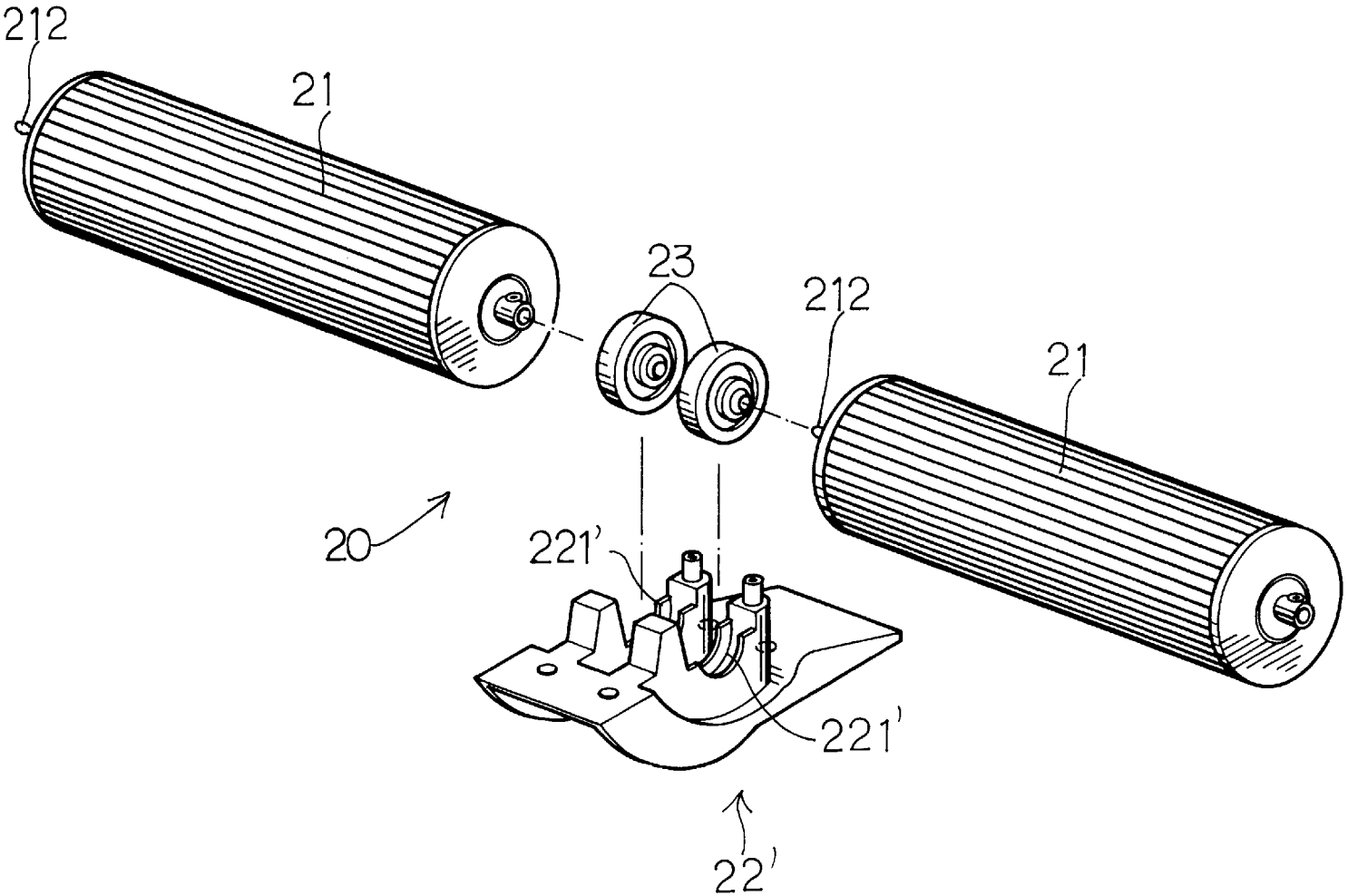
FIG. 6 is an exploded perspective view illustrating a single bearing seat with a double arcuate trough arrangement of the blower assembly according to the invention.

As shown in FIGS. 4 and 6, there is shown a second embodiment of the blower assembly consisting of three blower units 21 and two motors 24 for the split air conditioner according to the invention. This can further increase draft. Also, a single bearing seat 22' with a double arcuate trough 221 is provided. The shaft 212 of one blower unit 21 is inserted through the bearing 23 which is rested on the trough 221'.

Figure 7:
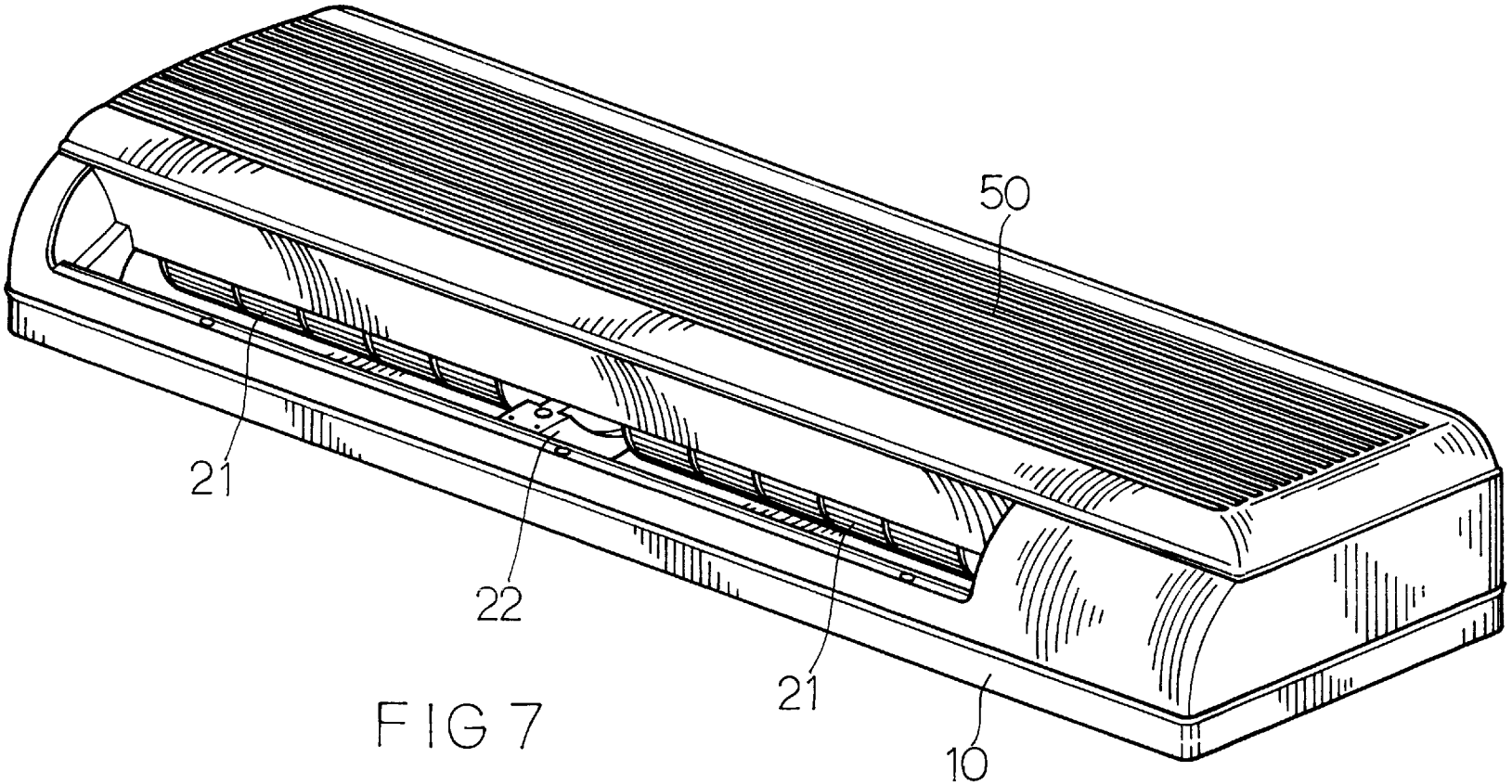
FIG. 7 is a perspective view of the air conditioner illustrated in FIG. 1.
Figure 8:
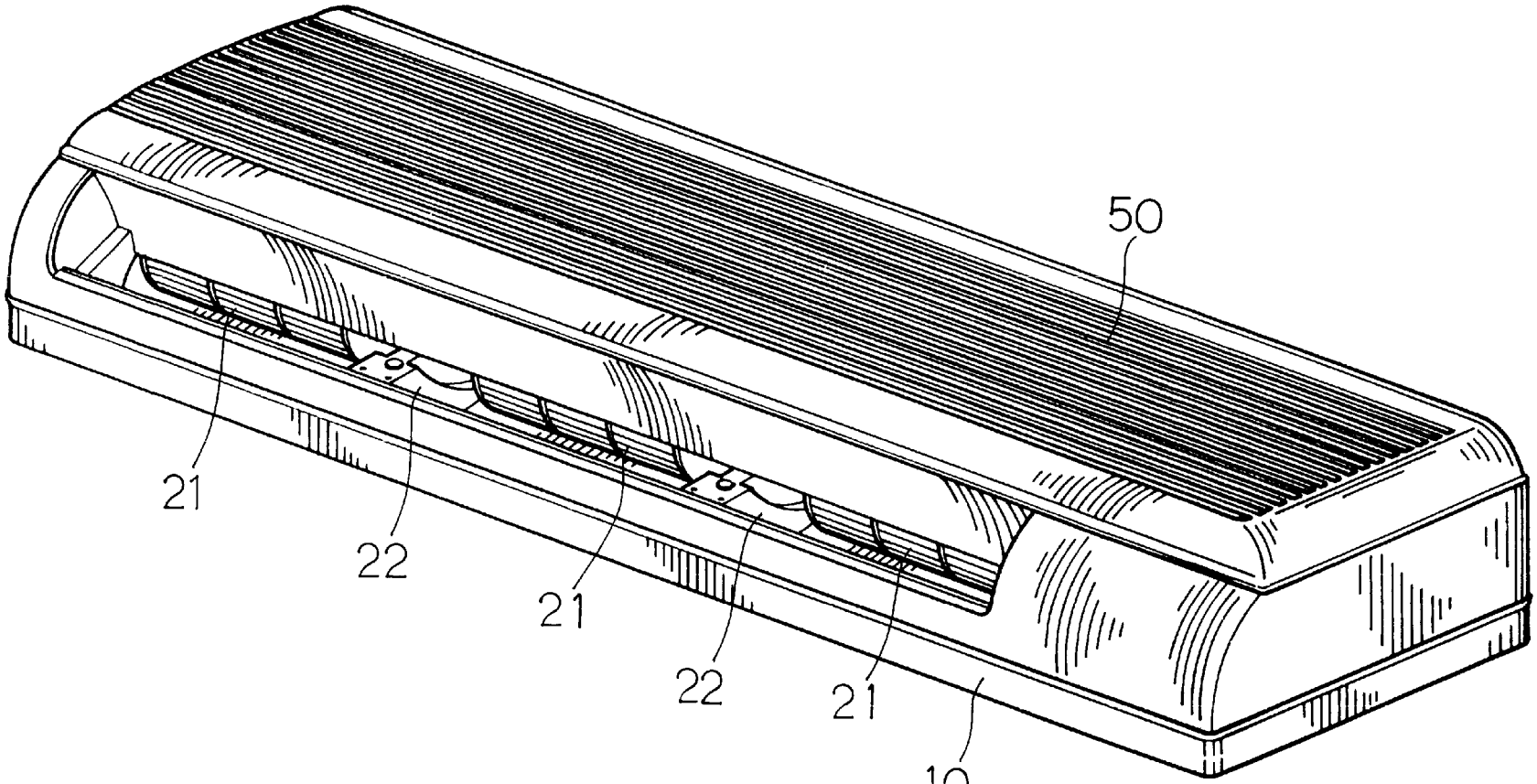
FIG. 8 is a perspective view of the air conditioner illustrated in FIG. 4.
Figure 9:
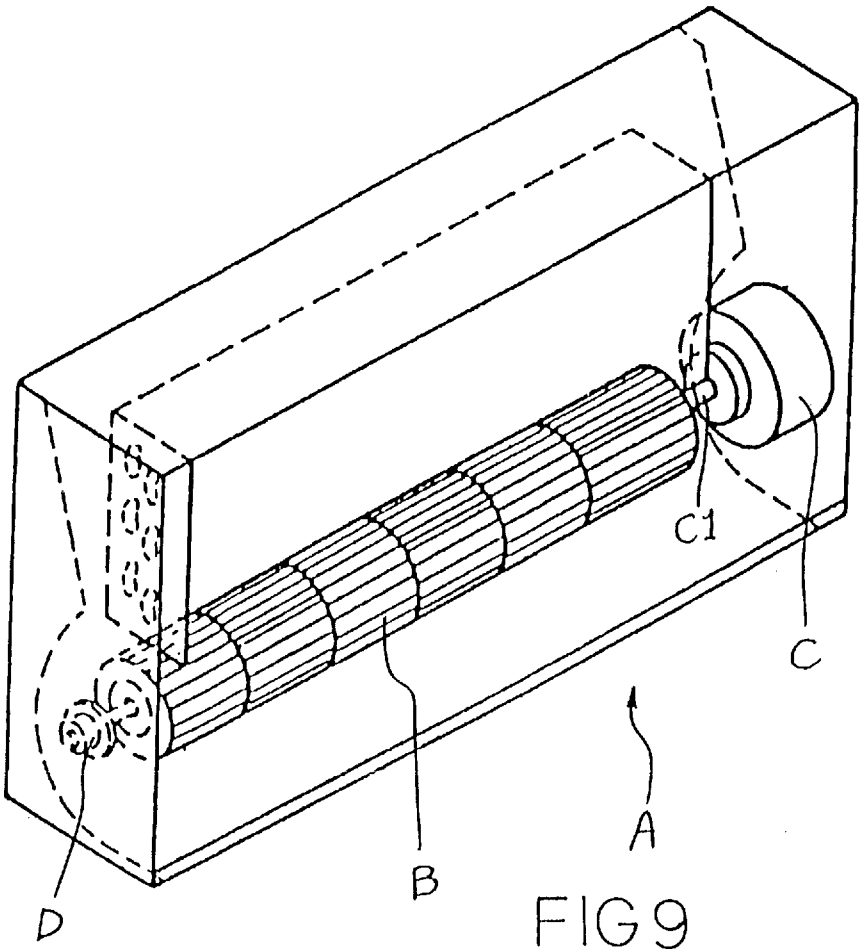
FIG 9 PRIOR ART
FIG. 9 is a schematic perspective view of a conventional blower assembly for the split air conditioner.

Referring to FIGS. 7 and 8, it is seen that two air openings (FIG. 7) and three air openings (FIG. 8) are formed in the air conditioner respectively. Further, blower assembly is supported by a plurality of segments. Hence, it is stable.

While the invention has been described by means of specific embodiments, numerous modifications and variations could be made thereto by those skilled in the art without departing from the scope and spirit of the invention set forth in the claims.

What is claimed is:

1. A blower assembly of a split air conditioner comprising:

a casing including a bearing trough in one end, a pair of rubber sleeve troughs in the other opposite end, a plurality of central hollow posts each having a threaded hole; and a blower including a plurality of blower units each having a shaft in one end and a hole in the other opposite end, at least one arcuate bearing seat, a plurality of bearings, at least one motor, a plurality of rubber sleeves mounted on said motor and rested together on said rubber sleeve troughs, and a plurality of plates for threadedly securing said rubber sleeves.

2. The blower assembly of claim 1, wherein said arcuate bearing seat is shaped to conform to the bottom of said casing.

* * * * *